US009836956B2

(12) United States Patent
Shearer

(10) Patent No.: US 9,836,956 B2
(45) Date of Patent: Dec. 5, 2017

(54) TRAINABLE TRANSCEIVER WITH ORIENTATION BASED ANTENNA POWER CONTROL

(71) Applicant: Gentex Corporation, Zeeland, MI (US)

(72) Inventor: Carl L. Shearer, Hudsonville, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/064,882

(22) Filed: Mar. 9, 2016

(65) Prior Publication Data

US 2016/0267783 A1 Sep. 15, 2016

Related U.S. Application Data

(60) Provisional application No. 62/131,119, filed on Mar. 10, 2015.

(51) Int. Cl.
*G08C 17/02* (2006.01)
*G08C 19/28* (2006.01)

(52) U.S. Cl.
CPC ..... *G08C 17/02* (2013.01); *G08C 19/28* (2013.01); *G08C 2201/20* (2013.01)

(58) Field of Classification Search
None
See application file for complete search history.

(56) References Cited

U.S. PATENT DOCUMENTS 7,864,070 B2 * 1/2011 Witkowski ..... G08C 19/28 340/12.24
8,253,528 B2 * 8/2012 Blaker ..... B60R 25/24 340/5.22
8,868,144 B2 * 10/2014 Shi ..... H01Q 1/243 455/277.1
9,100,100 B2 * 8/2015 Shi ..... H04L 1/18
9,324,230 B2 * 4/2016 Chutorash
2012/0294338 A1 11/2012 Zhan et al.
2013/0273870 A1 10/2013 Shi

FOREIGN PATENT DOCUMENTS

WO WO-2004/043750 A2 5/2004
WO WO-2013/019566 A1 2/2013

OTHER PUBLICATIONS

International Search Report and Written Opinion of the International Searching Authority received in corresponding International Application No. PCT/US2016/021475 dated Jun. 30, 2016, 9 pages.

* cited by examiner

*Primary Examiner* — K. Wong
(74) *Attorney, Agent, or Firm* — Foley & Lardner; Bradley D. Johnson

(57) ABSTRACT

A trainable transceiver for controlling a device includes an antenna configured to receive power from a power source, at least one orientation sensor, and a control circuit coupled to the antenna and the at least one orientation sensor. The control circuit is configured to determine an orientation of the antenna based on data from the at least one orientation sensor. The control circuit is further is configured to control the amount of power received by the antenna based on the determined orientation of the antenna. The trainable transceiver is configured to be capable of controlling the device based on at least one signal characteristic stored in memory and determined based on a signal received from an original transmitter.

17 Claims, 5 Drawing Sheets

TRAINABLE TRANSCEIVER WITH ORIENTATION BASED ANTENNA POWER CONTROL

CROSS-REFERENCE TO RELATED APPLICATIONS

This application claims the benefit of and to U.S. Provisional Application No. 62/131,119, filed Mar. 10, 2015, which is hereby incorporated by reference in its entirety.

FIELD

The present disclosure relates generally to the field of trainable transceivers for inclusion within a vehicle, and more particularly to a trainable transceiver for controlling an amount of power received by an antenna of the trainable transceiver based on a determined orientation of the antenna.

BACKGROUND

A trainable transceiver generally sends and/or receives wireless signals using a transmitter, receiver, and/or transceiver (e.g., using radio frequency transmissions). The wireless signals may be used to control other devices. For example, a trainable transceiver may send a wireless control signal to operate a garage door opener. A trainable transceiver may be trained to operate with a particular device. Training may include providing the trainable transceiver with control information for use in generating a control signal. Training may include enrolling the trainable transceiver with a device. A trainable transceiver may be incorporated in a vehicle (integrally or contained within the vehicle) and used to control devices outside the vehicle. It is challenging and difficult to develop a trainable transceiver which controls antenna power used for communicating with other devices such that the range of the trainable transceiver remains constant. It is further challenging and difficult to develop a trainable transceiver such that the strength of the electric field produced by the antenna remains constant in one direction as the orientation of the trainable transceiver is changed.

SUMMARY

One embodiment of the invention relates to a trainable transceiver for controlling a device. The trainable transceiver includes an antenna configure to receive power from a power source, at least one orientation sensor, and a control circuit coupled to the antenna and the at least one orientation sensor. The control circuit is configured to determine an orientation of the antenna based on data from the at least one orientation sensor. The control circuit is configured to control an amount of power received by the antenna based on the determined orientation of the antenna. The trainable transceiver is configured to be capable of controlling the device based on at least one signal characteristic stored in memory during a training process.

Another embodiment relates to a trainable transceiver for controlling a device. The trainable transceiver includes a plurality of antennas having different orientations, at least one orientation sensor, and a control circuit coupled to the plurality of antennas and the at least one orientation sensor. The control circuit is configured to determine an orientation of the trainable transceiver based on data from the at least one orientation sensor. The control circuit is configured to select an antenna from the plurality of antennas having different orientations based on the determined orientation of the trainable transceiver. The trainable transceiver is configured to be capable of controlling the device based on at least one signal characteristic stored in memory and determined based on a signal received from an original transmitter.

Another embodiment relates to a trainable transceiver for controlling a device. The trainable transceiver includes a plurality of antennas configured to be controlled as a phased array, at least one orientation sensor, and a control circuit coupled to the plurality of antennas and the at least one orientation sensor. The control circuit is configured to determine an orientation of the trainable transceiver based on data from the at least one orientation sensor. The control circuit is configured to control the antennas based on the determined orientation of the trainable transceiver. The trainable transceiver is configured to be capable of controlling the device based on at least one signal characteristic stored in memory and determined based on a signal received from an original transmitter.

Another embodiment relates to a method of controlling a transmission from a trainable transceiver for controlling a device. The method includes receiving, at a control circuit, information from an orientation sensor. The method includes determining, using the control circuit, the orientation of the trainable transceiver. The method includes adjusting, using the control circuit and based on the determined orientation, an amount of power provided to an antenna of the trainable transceiver for use in transmitting. The trainable transceiver is configured to be capable of controlling the device based on at least one signal characteristic stored in memory and determined based on a signal received from an original transmitter.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
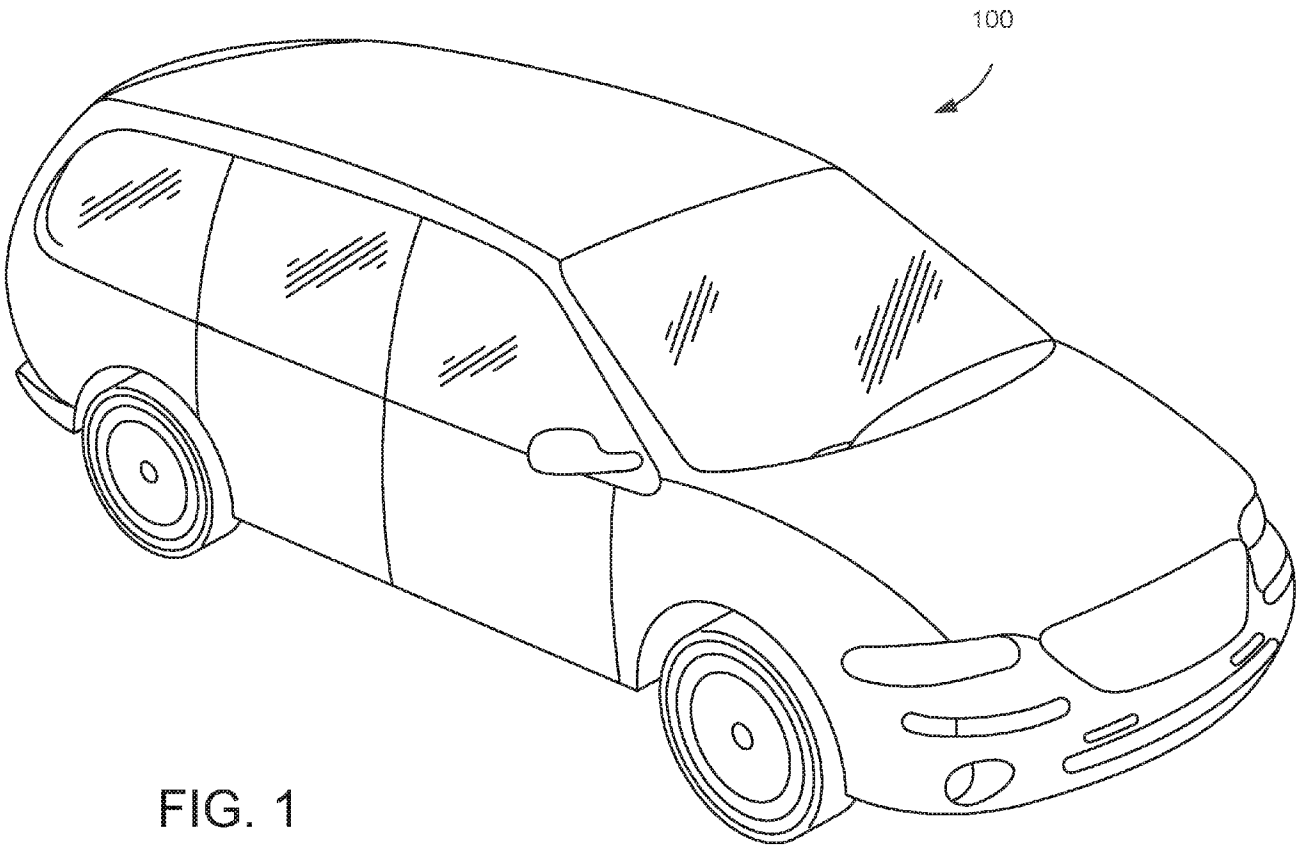
FIG. 1 illustrates a vehicle having a trainable transceiver, according to an exemplary embodiment.

Generally, a trainable transceiver controls one or more home electronic devices and/or remote devices. For example, the trainable transceiver may be a Homelink trainable transceiver. The trainable transceiver sends activation and/or control signals to home electronic devices and/or remote devices in order to control or otherwise communicate with the devices. As described herein, a trainable transceiver according to some embodiments may compensate for changes in orientation using one or more controls for adjusting the amount of power provided to various antenna elements for transmissions based on a determined orientation of the trainable transceiver. Following a general discussion of trainable transceivers, this and other embodiments of the trainable transceiver capable of determining orientation are described with reference to the FIGURES.

With respect to trainable transceivers for controlling home electronics device and/or remote devices in general, home electronic devices may include devices such as a garage door opener, gate opener, lights, security system, and/or other device which is configured to receive activation signals and/or control signals. A home electronic device need not be associated with a residence but can also include devices associated with businesses, government buildings or locations, or other fixed locations. Remote devices may include mobile computing devices such as mobile phones, smartphones, tablets, laptops, computing hardware in other vehicles, and/or other devices configured to receive activation signals and/or control signals.

Activation signals may be wired or, preferably, wireless signals transmitted to a home electronic device and/or remote device. Activation signals may include control signals, control data, encryption information (e.g., a rolling code, rolling code seed, look-a-head codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver used to send activation signals and/or other information to home electronic devices and/or remote devices. The same wireless transmission scheme, protocol, and/or hardware may be used for transmitting and receiving. The trainable transceiver may have two way communication with home electronic devices and/or remote devices. In other embodiments, the trainable transceiver includes additional hardware for two way communication with devices and/or receiving information from devices. In some embodiments, the trainable transceiver has only one way communication with a home electronic device. The trainable transceiver may receive information about the home electronic device from a remote device in a separate communication. The information about the home electronic device and/or remote device may be received from an intermediary device such as an additional remote device and/or mobile communication device.

A trainable transceiver may also receive information from and/or transmit information to other devices configured to communicate with the trainable transceiver. For example, a trainable transceiver may receive information from cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as a global positioning system or other navigation devices, laptops, personal computers, and/or other devices. In still further embodiments, the trainable transceiver is configured to communicate with networking equipment such as routers, servers, switches, and/or other hardware for enabling network communication. The network may be the internet and/or a cloud architecture.

The trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz), although other frequencies may be used. In other embodiments, a trainable transceiver may include additional hardware for transmitting and/or receiving signals (e.g., activation signals and/or signals for transmitting and/or receiving other information). For example, a trainable transceiver may include a light sensor and/or light emitting element, a microphone and/or speaker, a cellular transceiver, an infrared transceiver, or another communication device.

The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and detect the control information of the received signal. In some embodiments, an original transmitter is a transmitter produced by the manufacturer of home electronics device, remote device, or other device for use specifically with the corresponding device. For example, an original transmitter may be a transmitter which is sold separately from a home electronics device, remote device, or other device but is intended to work with that device. The original transmitter may be a transmitter or transceiver that is part of a retrofit kit to add functions to an existing home electronics device, remote device, or other device. An original transmitter may be a transmitter or transceiver that is not manufactured by or under license from the manufacturer or owner of a home electronics device, remote device, or other device.

Referring to the FIGURES generally, a trainable transceiver is configured to control the power provided to an antenna for transmitting control signals and/or other signals. Power provided to the antenna for transmitting signals may be controlled by a control circuit of the trainable transceiver. The power to the antenna may be controlled to produce a specific antenna radiation pattern or beam pattern. For example, the strength of the electric field produced by the antenna, range of the transmission and/or antenna radiation pattern, and/or other characteristics of the radio frequency transmission from the trainable transceiver may be controlled or affected by the amount of power provided to the antenna for transmission.

Control of the amount of power provided to the antenna, and in turn control over the resulting electric field strength and/or beam pattern produced by the antenna during transmission, may be used for one or more applications. In one embodiment, the amount of power provided to the antenna for transmissions (e.g., control or activation signals) is controlled such that the trainable transceiver has substantially the same range regardless of orientation. Advantageously, this may provide a consistent user experience regardless of the orientation of the trainable transceiver. As described in greater detail with reference to FIG. 3, orientation of the trainable transceiver may be determined using one or more orientation/position sensors such as accelerometers, inclinometers, a compass, a global positioning system receiver, gyroscopes, and/or other sensors.

Figure 4B:
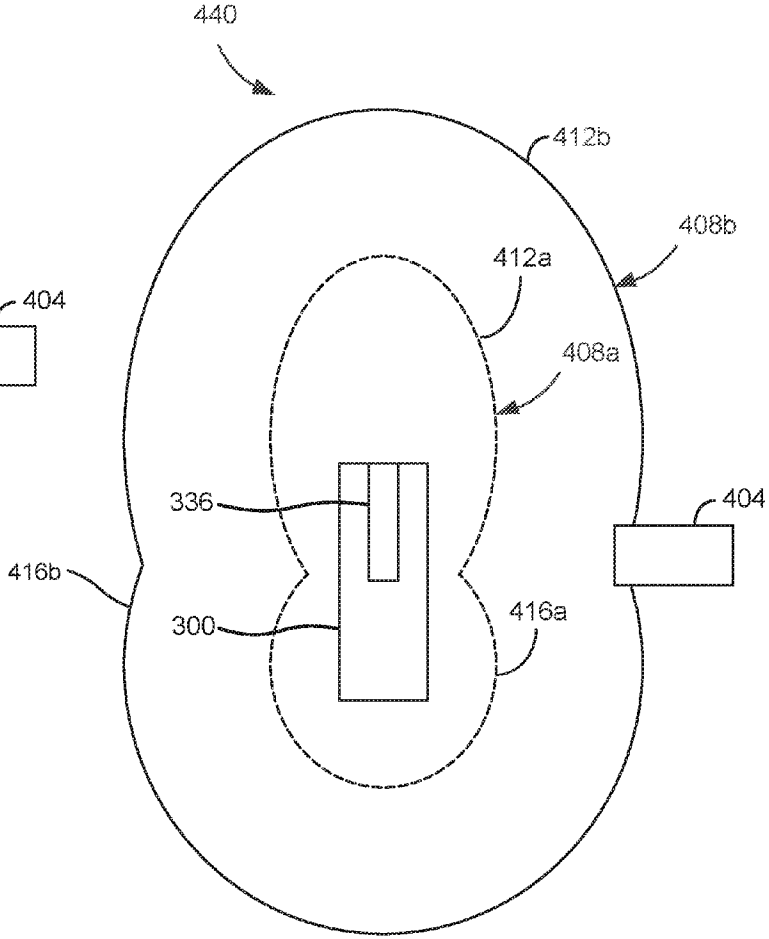
FIG. 4B illustrates a trainable transceiver, at a second orientation and with increased antenna power, having an antenna radiation pattern which reaches the receiver, according to an exemplary embodiment.
Figure 4A:
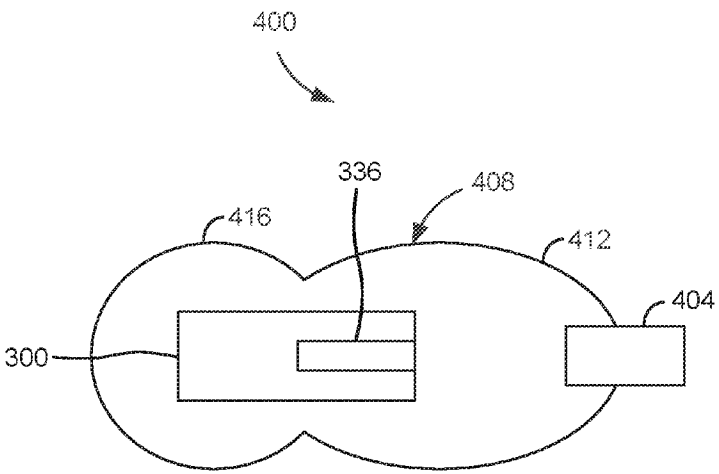
FIG. 4A illustrates a trainable transceiver, at a first orientation, having an antenna radiation pattern which reaches a receiver, according to an exemplary embodiment.

In some cases, the trainable transceiver may be oriented such that the main lobe of the antenna emissions is not directed toward a receiver and/or a device to be controlled (e.g., compare FIGS. 4A and 4B). The trainable transceiver may determine this based on information from the orientation/position sensor(s) (e.g., using a control circuit and orientation module in memory). The trainable transceiver may then adjust the power provided to the antenna in order to increase the strength and/or range of the electric field produced by the antenna and thereby increase the transmission range of the trainable transceiver with respect to the direction in which the receiver or device to be controlled is located. In some cases, the trainable transceiver may be installed or held by a user such that the antenna beam pattern is directed toward a device to be controlled. For example, a user within a vehicle holds the trainable transceiver such that it is directed toward a garage door opener to be controlled. Examples of instances in which the orientation of the trainable transceiver is such that the main lobe of the antenna beam pattern is not directed toward a receiver or device to be controlled include the following. In some cases, a user operating a handheld trainable transceiver may have the trainable transceiver orientated such that the trainable transceiver is tilted or rotated away from a receiver or device to be controlled (e.g., pointed upward or downward). In other cases, a trainable transceiver and/or the antenna thereof may be installed in or integrated with a vehicle in such a way that the antenna beam pattern is not directed outward from the front of the vehicle (e.g., the main lobe of the antenna beam pattern is directed outward from the side of the vehicle). By adjusting the power provided to the antenna, the trainable transceiver may provide a transmission (e.g., control signal and/or activation signal) with substantially the same range in the direction of the receiver or the device to be controlled regardless of the orientation of the trainable transceiver. The power may be increased such that the portion of the antenna beam pattern in the direction of the receiver or device to be controlled has the same electric field strength and/or range as the main lobe would have if the trainable transceiver were oriented towards the receiver and/or controlled device.

In another embodiment, control of the amount of power provided to the antenna, and in turn control over the resulting electric field strength and/or beam pattern produced by the antenna during transmission, may be used to limit the strength of the electric field produced by the antenna during transmission in any particular direction and/or orientation. For example, a maximum power threshold in any particular direction may be set. The control circuit of the trainable transceiver may provide power or limit the power provided to the antenna such that the maximum power threshold is not exceeded. In some embodiments, the maximum power threshold may be for a fixed point relative to the trainable transceiver. The trainable transceiver may use information from position/orientation sensors to determine the orientation of the trainable transceiver and in turn determine the orientation of the main lobe of the beam pattern produced by the antenna. The power provided to the antenna may be limited such that the beam pattern and associated electric field has a strength lower than the maximum power/strength threshold at the point relative to the trainable transceiver regardless of the orientation of the trainable transceiver. For example, the power provided to the antenna may be increased if the main lobe of the antenna beam pattern is oriented away from the fixed point having the maximum electric field strength threshold. The power provided to the antenna may be decreased if the main lobe of the antenna beam pattern is oriented toward the fixed point having the maximum electric field strength threshold. In either case, the power provided to the antenna is limited and/or controlled such that the maximum electric field strength threshold for the point is not exceeded.

Referring now to FIG. 1, a vehicle 100 is illustrated according to one embodiment. In some embodiments, a trainable transceiver is located within, mounted to, removably attached to, and/or otherwise associated with a vehicle 100. The trainable transceiver may be mounted or otherwise attached to a vehicle 100 in a variety of locations. For example, a trainable transceiver may be integrated into a dashboard or center stack (e.g., infotainment center) of a vehicle 100. The trainable transceiver may be integrated into the vehicle 100 by a vehicle manufacturer. A trainable transceiver may be located in other peripheral locations. For example, a trainable transceiver may be removably mounted to a visor. The trainable transceiver may include mounting hardware such as a clip. A trainable transceiver may be mounted to other surfaces of a vehicle 100 (e.g., dashboard, windshield, door panel, or other vehicle component). For example, a trainable transceiver may be secured with adhesive. In some embodiments, a trainable transceiver is integrated in a rear view mirror of the vehicle 100. A vehicle manufacturer may include a trainable transceiver in the rear view mirror.

In other embodiments, a vehicle 100 may be retrofit to include a trainable transceiver. This may include attaching a trainable transceiver to a vehicle surface using a clip, adhesive, or other mounting hardware as described above. Alternatively, it may include replacing a vehicle component with one that includes an integrated trainable transceiver and/or installing a vehicle component which includes an integrated trainable transceiver. For example, an aftermarket rear view mirror, vehicle camera system (e.g., one or more cameras and one or more display screens), and/or infotainment center may include an integrated trainable transceiver. In further embodiments, one or more components of a trainable transceiver may be distributed within the vehicle 100. For example and discussed in greater detail with respect to FIG. 3, an operator input device for receiving user input and/or providing output may be located within the vehicle 100 remotely from the antenna and/or other components of the trainable transceiver.

In one or more of these embodiments, the trainable transceiver may be installed, removably attached, or otherwise attached to or integrated with the vehicle 100 in a variety of orientations. In some embodiments, the trainable transceiver, or a portion thereof, is installed in a vehicle 100 by a vehicle manufacturer or retrofitter. The manufacturer, installer, and/or retrofitter may install the trainable transceiver such that the antenna is not positioned with the main lobe of the beam pattern directed forward relative to the car (e.g., the typical direction in which the vehicle will be facing a garage door opener or other home electronics device when the user causes the transmission of a control and/or activation signal for operating the device). For example, a manufacturer, installer, and/or retrofitter may be limited in the orientations in which the trainable transceiver may be installed due to space constraints, mounting point constraints, electromagnetic interference from other electronics and/or vehicle structures (e.g., body panels, structural elements, etc.), and/or other design considerations. Advantageously, the trainable transceiver may be installed in a variety of orientations and the trainable transceiver may adjust the power to the antenna such that the effective range of the trainable transceiver in the direction forward relative to the vehicle 100 remains the same throughout the variety of orientations. As described in greater detail with reference to FIGS. 3-4B, a control circuit of the trainable transceiver may determine the orientation of the trainable transceiver, and/or the antenna and main lobe of the antenna beam pattern, based on input from orientation/position sensor(s). The control circuit may then adjust the power provided to the antenna during transmission of signals (e.g., activation signals) such that the portion of the beam pattern extending outward from the front of the vehicle 100 has the same effective range as if the main lobe of the beam pattern were oriented in this direction.

Still referring to FIG. 1, the vehicle 100 is illustrated as automobile. However, the vehicle 100 may be any type of vehicle. The vehicle 100 may be a car, truck, sport utility vehicle, tractor trailer, or other automobile. The vehicle 100 may be a motorcycle or other two or three wheeled vehicle. In still further embodiments, the vehicle 100 may be an airborne vehicle (e.g., airplane, helicopter, etc.), or waterborne vehicle (e.g., boat, personal watercraft, etc.).

Figure 2:
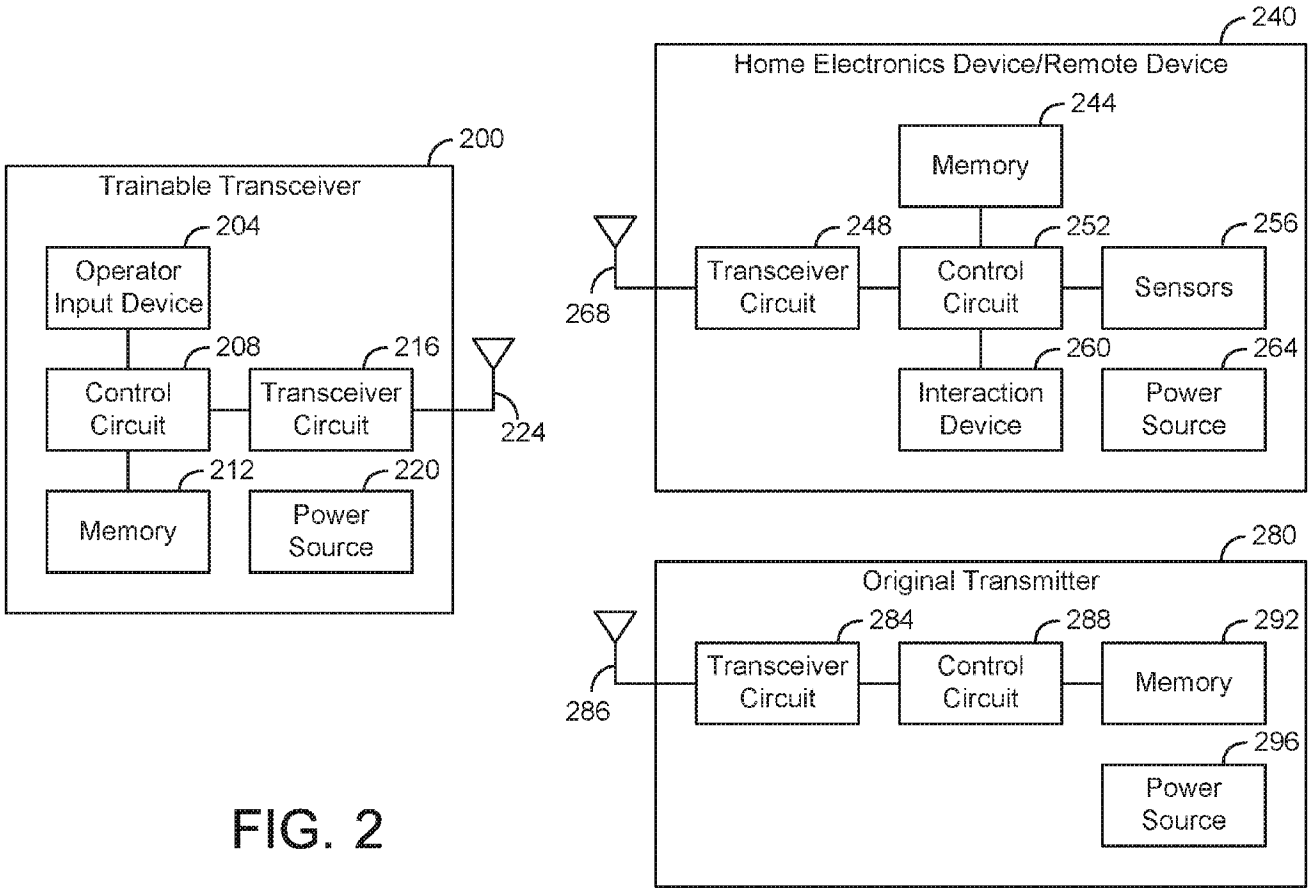
FIG. 2 illustrates a block diagram of a trainable transceiver, home electronics device, and original transmitter, according to an exemplary embodiment.

Referring now to FIG. 2, block diagrams of a trainable transceiver 200, home electronics device 240, and original transmitter 280 are illustrated according to one embodiment. The trainable transceiver 200 may include an operator input device 204, control circuit 208, memory 212, transceiver circuit 216, antenna 224, power source 220, and/or other components. The operator input device 204 is configured to receive user inputs and/or provide output to the user. In one embodiment, the operator input device 204 includes a series of buttons for receiving user input. In some embodiments, the operator input device 204 includes one or more light emitting diodes (LEDs) for providing output to the user. In further embodiments, the operator input device 204 includes one or more of switches, capacitive buttons, a touch screen display, liquid crystal display, microphone, speaker, and/or other input or output elements.

The control circuit 208 of the trainable transceiver 200 is configured to receive inputs from the operator input device 204. In response to inputs from the operator input device 204, the control circuit 208 may cause the transceiver circuit 216 to transmit an activation signal, control signal, and/or other signal. The control circuit 208 may use information in memory 212 in order to cause the transceiver circuit 216 to format a signal for reception by a particular home electronics device or remote device 240. For example, memory 212 may include an identifier of the device, encryption information, frequencies for use in transmitting to the device, and/or other information.

The control circuit 208 may also receive inputs via the operator input device 204 and in response place the trainable transceiver 200 into a training mode. While in the training mode, an activation signal transmitted by the original transmitter 280 may be received by the transceiver circuit 216 of the trainable transceiver 200. The control circuit 208 of the trainable transceiver 200 may store one or more characteristics of the received activation signal in memory 212 for use in formatting control signals to be sent using the transceiver circuit 216. For example, stored characteristics may include, information identifying a home electronics device or remote device 240, encryption information, frequency, and/or other characteristics of the activation signal sent by the original transmitter 280 and received by the transceiver circuit 216 of the trainable transceiver 200. In some embodiments, the control circuit 208 may cause the operator input device 204 to provide an output (e.g., illuminate an LED) when the signal from the original transmitter 280 is received and one or more characteristics are stored in memory 212.

In some embodiments, the control circuit 208 also controls the amount of power provided to the antenna 224 and/or transceiver circuit 216 for use in transmitting activation signals, control signals, and/or otherwise transmitting. As explained in more detail with reference to FIG. 3, the control circuit 208 may include one or more modules which control the amount of power provided to the antenna 224. The amount of power provided to the antenna 224 may be controlled based wholly or in part on the orientation of the trainable transceiver 200. The orientation may be determined by the control circuit based 208 on input from one or more orientation/position sensors included in the trainable transceiver 200.

The trainable transceiver 200 also includes a power source 220 in some embodiments. The control circuit 208 may control the power source 220 such that the antenna 224 and/or transceiver circuit 216 is provided with an amount of power determined based on the orientation of the trainable transceiver 200. In one embodiment, the power source 220 is or includes a vehicle power system. For example, the power source 220 may be a vehicle power system including a battery, alternator or generator, power regulating equipment, and/or other electrical power equipment. In further embodiments, the power source 220 may include components such as a battery, capacitor, solar cell, and/or other power generation or storage equipment.

Still referring to FIG. 2, the trainable transceiver 200 is configured to be trained to control a home electronics device and/or remote device 240. A home electronics device and/or remote device 240 may be any remotely controlled device. Examples of home electronics device and/or remote devices 240 include garage door openers, lighting control systems, movable barrier systems (e.g., motorized gates, road barriers, etc.), multimedia systems, and/or other systems controllable by an activation signal and/or control signal. Home electronics devices and/or remote devices 240 may include an antenna 268 and a receiver or transceiver circuit 248 for receiving transmissions from the trainable transceiver 200 and/or an original transmitter 280. Home electronics devices and/or remote devices 240 may also include a control circuit 252 and/or memory 244 for processing the received signal. For example, an activation signal from a trainable transceiver 200 or original transmitter 280 may be received by an antenna 268 and receiver circuit 248. The control circuit 252 may determine if encryption information transmitted as part of the activation signal matches an expected value. The control circuit 252 may cause an interaction device 260 to activate. For example, the home electronics devices and/or remote devices 240 may be a garage door opener and the interaction device 260 may be a motor for opening and/or closing the garage door. Upon receipt of the activation signal at the transceiver or receiver circuit 248, the control circuit 252 may activate the motor after determining that the activation signal included valid encryption information such as a key value.

Home electronics devices and/or remote devices 240 may include a power source 264 for powering the interaction device 260 and/or other components. For example, the power source 264 may be a connection to a home, office, or other structure's power system (e.g., one or more circuits drawing power from mains power). The power source 264 may be or include other components such as a battery.

In further embodiments, home electronics devices and/or remote devices 240 may include additional components such as sensors 256. Sensors 256 may be or include cameras, light sensors, motion sensors, garage door position sensors, and/or other sensors. Home electronics devices and/or remote devices 240 may use a transceiver circuit 248 to transmit information from or determined based on the sensors 256 to the trainable transceiver 200. The trainable transceiver 200 may display this information using the operator input device 204.

Still referring to FIG. 2, home electronics devices and/or remote devices 240 may be sold with or otherwise be associated with an original transmitter 280. An original transmitter 280 may be a transmitter provided by the manufacturer of the home electronics devices and/or remote devices for 240 wirelessly controlling the home electronics devices and/or remote devices 240. In alternative embodiments, the original transmitter 280 may be a transmitter sold separately from the home electronics device and/or remote device 240 which is configured to control the home electronics device and/or remote device 240. For example, the original transmitter 280 may be a retrofit product, trainable transceiver, and/or other transmitter configured to control the home electronics device and/or remote device 240.

In some embodiments, the original transmitter 280 includes a transceiver circuit 284, control circuit 288, memory 292, power source 296, and/or other components. The transceiver circuit 284 may be a transceiver or transmitter and may be coupled to and/or include an antenna 286. The control circuit 288 may control the transceiver 284 to format and transmit an activation signal and/or control signal based on information stored in memory 292 (e.g., device identification information, encryption information, frequency, and/or other information). The control circuit 288 may also handle inputs received from an operator input device such as button included in the original transmitter 280. The original transmitter 280 may have a power source 296 such as a battery.

Figure 3:
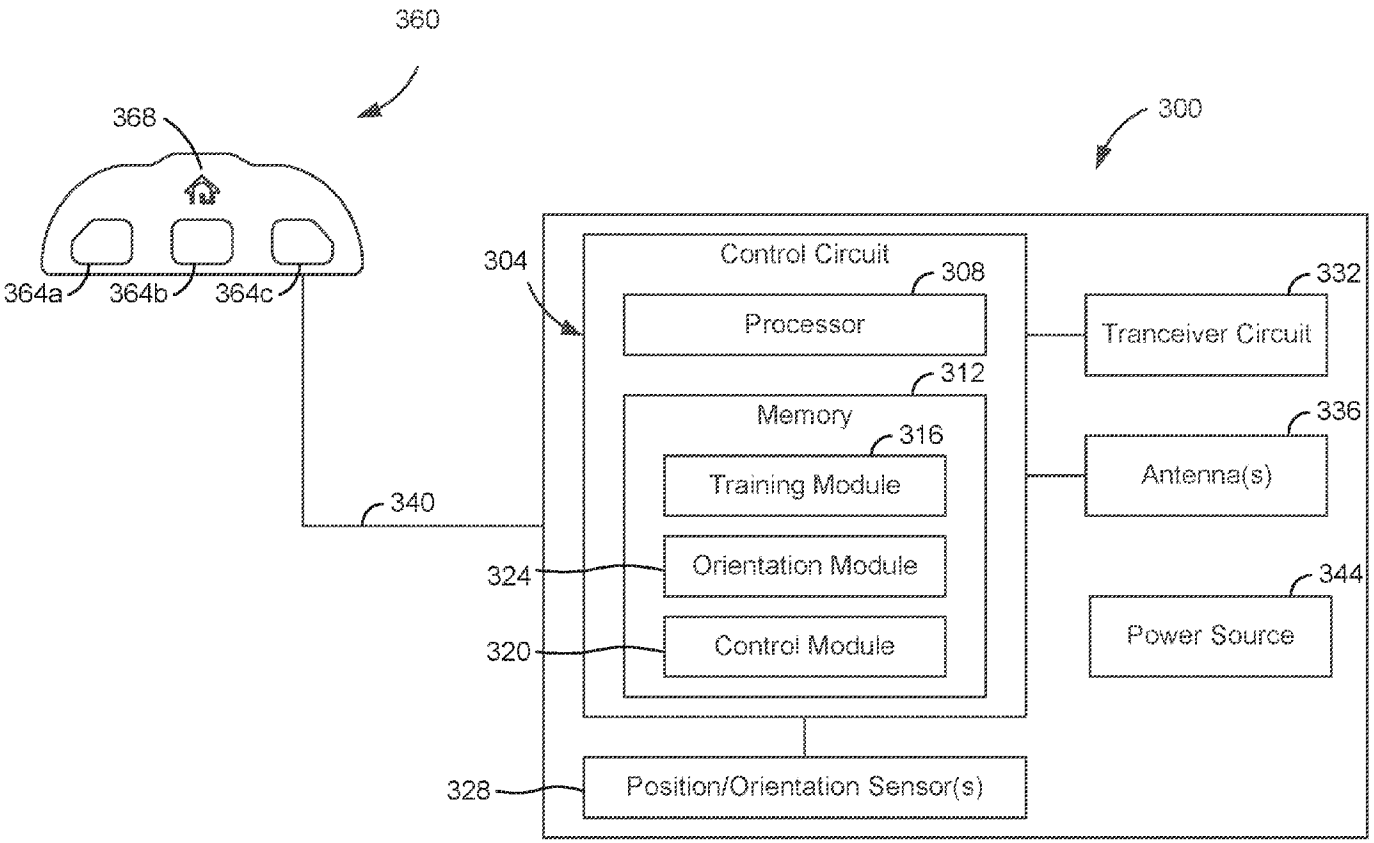
FIG. 3 illustrates a trainable transceiver including a remote operator input device and position/orientation sensor (s), according to an exemplary embodiment.

Referring now to FIG. 3, a block diagram of a trainable transceiver 300 is illustrated according to one embodiment. A trainable transceiver 300 may include one or more of the components or features illustrated and described with reference to FIG. 3 and/or one or more of the components or features illustrated and described with reference to FIG. 2.

In some embodiments, the trainable transceiver 300 includes an operator input device 360 located remotely from one or more other components of the trainable transceiver 300. For example, in embodiments in which the trainable transceiver 300 is installed in or otherwise integrated with a vehicle (e.g., vehicle 100 shown in FIG. 1, etc.), the operator input device 360 may be located within the cabin of the vehicle 100, and one or more other components of the trainable transceiver 300 may be located in other locations (e.g., in an engine bay, in a trunk, behind or within a dashboard, in a headliner, elsewhere in the cabin and/or in other locations). This may allow for installation of the trainable transceiver 300, including the antenna 336, in a variety of locations and/or orientations. Advantageously, the trainable transceiver 300 may control the amount of power provided to the antenna during 300 transmissions such that the effective range and/or strength of the electric field remains constant in one direction (e.g., forward relative to the vehicle 100) regardless of the orientation in which the components of the trainable transceiver 300 are installed in the vehicle 100.

In one embodiment, the operator input device 360 includes a series of buttons 364*a-c* and an illuminable logo, design, light, or other feature 368. Each button 364 may be trained to operate a different home electronics device and/or remote device (e.g., home electronics device/remote device 240 shown in FIG. 2, etc.) using one or more of the training procedures described herein. The illuminable feature 368 of the operator input device 360 may be used to communicate information to the user of the trainable transceiver 300.

Still referring to FIG. 3, the trainable transceiver 300 may include components located remotely from the operator input device 360. One or more of these components (e.g., the control circuit 304) may be in communication with the operator input device 360. In one embodiment, a wired connection 340 allows for communication between the operator input device 360 and the other components of the trainable transceiver 300. In alternative embodiments, a wireless connection between the operator input device 360 and the other components is used. The operator input device 360 may include a wireless transceiver configured to communicate with the other components using the transceiver circuit 332 and/or a second transceiver (e.g., WiFi transceiver, Bluetooth transceiver, optical transceiver, and/or other transceiver) located with the other components remote from the operator input device 360.

The trainable transceiver 300 may include a transceiver circuit 332 and/or one or more antennas 336 included in or coupled to the transceiver circuit 332. In some embodiments, the trainable transceiver 300 includes a single fixed antenna 336. The antenna 336 may be fixed to and/or relative to a housing containing components of the trainable transceiver 300 such as the control circuit 304, position/orientation sensors 324, transceiver circuit 332, power source 344, and/or the antenna 336 itself. Alternatively, the antenna 336 may be positionable during installation of the trainable transceiver 300 but thereafter remain fixed. In still further embodiments, the antenna 336 is located remotely from other components and connected via a wired connection to the transceiver circuit 332 and/or power source 344.

The antenna 336 is configured to receive a variable amount of power. The amount of power provided to the antenna 336 is controlled by the control circuit 304 and/or transceiver circuit 332. For example, the control circuit 304 and/or transceiver circuit 332 may include power regulation components such as voltage dividers, current dividers, transformers, diodes, capacitors, and/or other electronics which can control the amount of power provided to the antenna. The power may be provided from the power source 344.

The antenna 336 may be one or a combination of a variety of antenna types. For example, the antenna 336 may be or include a dipole antenna, loop antenna, slot antenna, parabolic reflector, horn, monopole, helical, and/or other type of antenna. The antenna 336 may be omnidirectional, weakly directional, or directional.

The trainable transceiver 300 includes one or more position/orientation sensors 324. The one or more position/orientation sensors 324 are coupled to the control circuit 304 and configured to provide information related to the position and/or orientation of the trainable transceiver antenna 336.

In cases in which the trainable transceiver 300 includes the antenna 336 in the same housing as other components, the position/orientation sensor(s) 324 are included within the housing as well. In cases where the antenna 336 is located remotely, the position/orientation sensor(s) 324 are located with the antenna 336. This allows the position/orientation sensor(s) 324 to provide information used by the control circuit 304 to determine the position and/or orientation of the antenna 336.

In some embodiments, the position/orientation sensor(s) 324 include one or more sensors for determining orientation. In one embodiment, the position/orientation sensor 324 is a multi-axis accelerometer. In other embodiments, the position/orientation sensor(s) 324 include one or more of a multi-axis accelerometer, single axis accelerometers, magnetometers, inclinometers, gyroscopes, compass, and/or other sensors for determining orientation and/or changes in orientation. In some embodiments, the position/orientation sensor(s) 324 include one or more sensors for determining position. In one embodiment, the position/orientation sensor 324 is an integrating multi-axis accelerometer. In other embodiments, the position/orientation sensor 324 may include one or more of an integrating accelerometer, global positioning system, dead reckoning positioning system, and/or other position sensor. In still further embodiments, the position/orientation sensor(s) 324 includes one or more sensors of the types described above and/or other types for measuring orientation, position, and/or a combination of orientation and position. The orientation/position sensor(s) 324 may include a plurality of sensors of various types to measure both position and orientation. The position/orientation sensors 324 may measure or otherwise provide information related to the position of the trainable transceiver 300 relative to a fixed point (e.g., the location at which the trainable transceiver 300 was trained); the pitch, roll, and/or yaw of the trainable transceiver 300 relative to the vehicle 100 or gravity; a spherical angle of orientation relative to the vehicle 100 or gravity; and/or other information which partially or completely defines the orientation and/or position of the trainable transceiver 300.

In still further embodiments, the trainable transceiver 300 may use position and/or orientation information received from another source. The trainable transceiver 300 may not include dedicated position/orientation sensor(s). For example, the control circuit 304 may be in communication with one or more vehicle systems with position and/or orientation sensors. The trainable transceiver 300 may receive position information from a global positioning system included within the vehicle 100. In other embodiments, the trainable transceiver 300 may be in communication with a device such as smartphone, tablet, or other mobile computing device. The trainable transceiver 300 may receive position and/or orientation data from this or another device.

The control circuit 304 of the trainable transceiver may include one or more modules in memory 312 for carrying out and/or facilitating the operation of the trainable transceiver 300 described herein. For example, the control circuit 304 may include a training module 316 in memory 312. The training module 316 may include instructions, programs, executable code, and/or other information which is used by the control circuit 304 to perform training functions. The modules of the control circuit 304 may be executed or otherwise handled or implemented using a processor 308. The processor 308 may be a general or application specific processor or circuit for performing calculations, handling inputs, generating outputs, and/or otherwise performing computational tasks. For example, when a specific input is received by the control circuit 304 (e.g., a button depressed for greater than 5 seconds), the training module 316 may include instructions for handling the input. The training module 316 may cause the control circuit 304 to use the transceiver circuit 3320 to wait for the reception of a signal from an original transmitter (e.g., original transmitter 280 shown in FIG. 2, etc.). The training module 316 may include instructions and/or programs for analyzing the received signal using one or more algorithms, look up tables, and/or other information structures/techniques. The training module 316 may also cause the storage of one or more characteristics of the received signal in memory 312.

In some embodiments, the memory 312 associated with the control circuit 304 includes an orientation module 328. The orientation module 328 may include instructions, programs, executable code, and/or other information which is used by the control circuit 304 to determine the orientation and/or position of the trainable transceiver 300 and/or antenna 336. The orientation module 328 may include instructions and/or programs which handle input received from one or more position/orientation sensor(s) 324. For example, the orientation module 328 may use formulas, algorithms, look up tables, and/or other techniques to calculate or otherwise determine the orientation or estimated orientation of the trainable transceiver 300 (and/or antenna 336) based on the received inputs. The orientation module 328 may determine changes in orientation and/or position based on information received from one or more accelerometers (e.g., determine changes in orientation based on the measurements received, track position by integrating the changes in orientation, etc.). The orientation module 328 may further use techniques such as look up tables in conjunction with information such as the current measurements provided by one or more inclinometers. The orientation module 328 may be used to determine an orientation relative to gravity based on the one or more inclinometer inputs and the associated orientations found in the lookup table. The orientation module 328 may receive inputs from any set or subset of the position/orientation sensors 324 described herein for use in determining the orientation of the trainable transceiver 300 and/or the antenna 336. In some embodiments, the orientation module 328 extrapolates the determined position and/or orientation of the trainable transceiver 300 in order to determine the orientation and/or position of the antenna 336. The orientation module 328 may include the use of algorithms such as Kalman filters, dynamic filters, and/or other algorithms for determining motion, orientation, and/or position.

The control circuit 304 may further include a control module 320. The control module 320 may include instructions, programs, executable code, and/or other information which is used by the control circuit 304 to control the power provided to the antenna 336 based on the determined position and/or orientation. A program, instructions, and/or other portion of the orientation module 328 may provide the control module 320 with the determined orientation of the antenna 336. The control module 320 may use this information in order to determine the amount of power to provide the antenna 336. In one embodiment, the control module 320 includes a lookup table of antenna power amounts corresponding with a plurality of possible orientations. Based on the determined orientation (e.g., relative to gravity) the control module 320 looks up a corresponding antenna power. The control circuit 304, according to the control module 320, then provides the transceiver circuit 332 and/or antenna 336 with this amount of power. In alternative embodiments, the control module 320 uses other techniques to determine the amount of power to provide the transceiver circuit 332 and/or antenna 336 based on the determined position and/or orientation. For example, the control module 320 may use one or more of following techniques to relate a determined position and/or orientation to an antenna power: a look up table, interpolation, extrapolation, a formula, an algorithm, a model, and/or other techniques.

In some embodiments, the determined position and/or orientation is relative to a fixed point or reference. The fixed point may be determined based on position data which is stored when the trainable transceiver 300 is first trained. The power provided to the transceiver circuit 332 and/or antenna 336 may be based on the position and/or orientation of the trainable transceiver 300 and/or antenna 336 relative to this fixed point. In some embodiments, the position and/or orientation may be determined in reference to a specific reference point. The reference point may be the position and/or orientation of the trainable transceiver 300 when the trainable transceiver 300 is powered up or otherwise turned on, the position and/or orientation of the trainable transceiver 300 following a predetermined time during which no changes in position and/or orientation are measured, the direction of gravity as measured by one or more other sensors (e.g., inclinometers), and/or other reference points.

The amount of power to be provided to the transceiver circuit 332 and/or the antenna 336 may be set (e.g., in a lookup table) or calculated (e.g., using a formula or algorithm) such that the amount of power and/or the strength of an electric field produced by the antenna 336 during transmission remains substantially constant at a fixed point relative to the trainable transceiver 300 and regardless of the orientation and/or position of the trainable transceiver 300 (e.g., in any orientation and/or position of the trainable transceiver 300, independent of the orientation and/or position of the trainable transceiver 300, etc.). In other words, the trainable transceiver 300 may have a preferred orientation at which the main lobe of the beam pattern produced by the antenna 336 extends towards a receiver, outward from the front of a vehicle, or otherwise extends in an advantageous direction. This provides a transmission with maximum power, range, and/or strength of electric field extends towards a receiver, outward from the front of a vehicle, or otherwise in an advantageous direction. When the orientation and/or position of the trainable transceiver 300 is altered, the main lobe of the antenna beam pattern no longer extends towards the receiver, outward from the front of the vehicle, or otherwise in the advantageous direction. As a result, the power, range, and/or electric field strength that extends towards the receiver, outward from the front of the vehicle, or otherwise in the advantageous direction is reduced at the same point. In order to compensate, the trainable transceiver 300 may increase the amount of power provided to the transceiver circuit 332 and/or antenna 336. This increases the power, range, and/or electric field strength of the transmission of the antenna 336 such that the power, range, and/or electric field strength remain constant as the position and/or orientation of the trainable transceiver 300 is changed. Although the beam pattern may not be optimized, the effect of the changing orientation of the trainable transceiver 300, and therefore of the beam pattern, at the point is reduced or eliminated by increasing the power to the transceiver circuit 332 and/or antenna 336. Advantageously, this may allow for the trainable transceiver 300 to be used, installed, or otherwise be in a variety of orientations without an effect noticeable by the user. For example, the effective range of the trainable transceiver 300 for controlling a home electronics device and/or remote device 240 may remain constant regardless of the orientation of the trainable transceiver 300.

In some embodiments, the amount of power to be provided to the transceiver circuit 332 and/or the antenna 336 may be set (e.g., in a lookup table) or calculated (e.g., using a formula or algorithm) such that the amount of power and/or the strength of an electric field produced by the antenna 336 during transmission remains does not exceed a peak threshold value at a fixed point relative to the trainable transceiver 300 and regardless of the orientation and/or position of the trainable transceiver 300. For example, the peak threshold value for electric field strength may be 12,500 μV/m, 5,000 μV/m, 2,250 μV/m, 1000 μV/m, 500 μV/m, 200 μV/m and/or other value at a fixed an stationary point 3 m and/or another distance away from the trainable transceiver 300. The fixed and stationary point may be the location of a receiver, antenna, piece of test equipment, home electronics device, remote device, and/or other equipment. The control circuit 304 may control the amount of power provided to or received by the transceiver circuit 332 and/or antenna 336 such that, when the trainable transceiver 300 and/or antenna 336 is oriented with the main lobe of the antenna beam pattern directed towards the fixed point, the peak value for the electric field strength is met or otherwise not exceeded at the fixed point. As the orientation of the trainable transceiver 300 is changed relative to the fixed point, the control circuit 304 may increase or decrease the power to the antenna 336 such that the peak value for the electric field strength at the fixed point is met or otherwise not exceeded. In some cases, the peak value for the electric field strength may be exceeded at locations other than the fixed point.

Referring now to FIGS. 4A and 4B, a trainable transceiver is illustrated is illustrated in a first orientation with a first power provided to the antenna and in a second orientation with a second power provided to the antenna, according to one embodiment. As explained herein, the trainable transceiver controls the power provided to the antenna and used for sending transmissions based on orientation and/or position of the trainable transceiver and/or antenna. The power provided may be controlled to maintain an effective range of the trainable transceiver, provide the same amount of power at a fixed point relative to the trainable transceiver, provide the same strength of the electric field generated by the antenna at a fixed point relative to the trainable transceiver, maintain the strength of the electric field generated by the antenna below a peak threshold value at a fixed point relative to the trainable transceiver, and/or otherwise control the antenna transmission to maintain a property regardless of the orientation and/or position of the trainable transceiver and/or antenna.

Referring now to FIG. 4A, a trainable transceiver (e.g., trainable transceiver 300 having components including antenna 336 as shown in FIG. 3, etc.) is illustrated in a first orientation 400 relative to a receiver 404 (e.g., home electronics device/remote device 240 shown in FIG. 2, testing equipment, and/or other receivers), according to one embodiment. The beam pattern 408 for the antenna 336 at a first power level is illustrated. For a first transmission, the trainable transceiver 300 may be oriented toward the receiver 404 such that the main lobe 412 of the antenna beam pattern 408 is oriented substantially toward the receiver 404. The beam pattern 408 may extend to or beyond the receiver 404. In this orientation 400, the receiver 404 is provided with the greatest amount of radio frequency power, the receiver 404 experiences the greatest electric field strength, and the trainable transceiver 300 has the greatest range for communicating with the receiver 404. This is due to the orientation of the main lobe 412 of the antenna beam pattern 408 towards the receiver 404. The side lobes and/or back lobe 416 of the beam pattern 408 are not directed toward the receiver 404. The trainable transceiver 300 may be caused to transmit a first transmission at this orientation 400 (e.g., by providing a user input through the operator input device 360). The amount of power provided to the antenna 336 may be set such that the electric field strength is at a peak threshold value.

Referring now to FIG. 4B, the trainable transceiver 300 is illustrated in a second orientation 440 relative to the receiver 404, according to one embodiment. Following the first transmission, the trainable transceiver 300 may be moved to a different orientation 440. For example, the trainable transceiver 300 may be rotated approximately 90 degrees. In this orientation 440, the main lobe 412*a* is not directed toward the receiver 404. Additionally, if the same amount of antenna power is used as in the first transmission, a second transmission may not have sufficient range to reach the receiver 404, may provide the receiver 404 with less radio frequency power than as in the first transmission, and/or may result in an electric field strength at the receiver which is substantially less than in the first transmission. The electric field strength measured at the receiver 404 may be substantially less than the peak threshold value. This scenario is illustrated in FIG. 4B using the dashed antenna beam pattern 408*a*.

The control circuit 304 may determine that the orientation of the trainable transceiver 300 has changed and/or determine the current orientation of the trainable transceiver 300. For example, the control circuit 304 may determine based on input from one or more position/orientation sensors 324 that the trainable transceiver 300 and/or antenna 336 is oriented 90 degrees counterclockwise from the previous orientation. In some embodiments, the trainable transceiver 300 may use the orientation at which the trainable transceiver 300 is first activated as a reference point or frame for changes in orientation. Based on the changed orientation, the control circuit 304 may change (e.g., increase or decrease) the amount of power provided to the transceiver circuit 332 and/or antenna 336 for the second transmission. For example, the control circuit 304, using the orientation module 328, may look up in a lookup table an amount of power to provide the transceiver circuit 332 and/or antenna 336 corresponding to an orientation of minus 90 degrees in a horizontal plane. For example, the value may be twice the amount of power provided. This results in a second transmission with increased power output as illustrated in FIG. 4B with the solid beam pattern 408*b*. The power value in the lookup table may be chosen such that, at the second orientation 440, the trainable transceiver 300 produces a second transmission which, in comparison to the first transmission, has substantially the same measured radio frequency power at the receiver 404, has substantially the same electric field strength measured at the receiver 404, has an electric field strength substantially equal to the peak threshold value, and/or otherwise provides a transmission that is substantially the same at the point at which the receiver 404 is located.

As illustrated in FIG. 4B, the second transmission may use increased antenna power such that a side lobe or portion thereof, portion of the main lobe 412*b*, and/or a back lobe 416*b* or portion thereof of the beam pattern 408*b* is used to transmit to the receiver 404. The main lobe 412*b* may extend beyond the receiver 404 and/or result in or have a higher radio frequency power, higher electric field strength, and/or greater range at points other than where the receiver 404 is located. In some embodiments, this is a result of the antenna 336 being a fixed antenna. In order to maintain the same power or electric field strength at the receiver 404 regardless of the orientation of the antenna, 336 the main lobe 412*b* of the produced beam pattern 408*b* may have characteristics with greater values than a side lobe or portion of the main lobe which is measured at the receiver 404.

Figure 5:
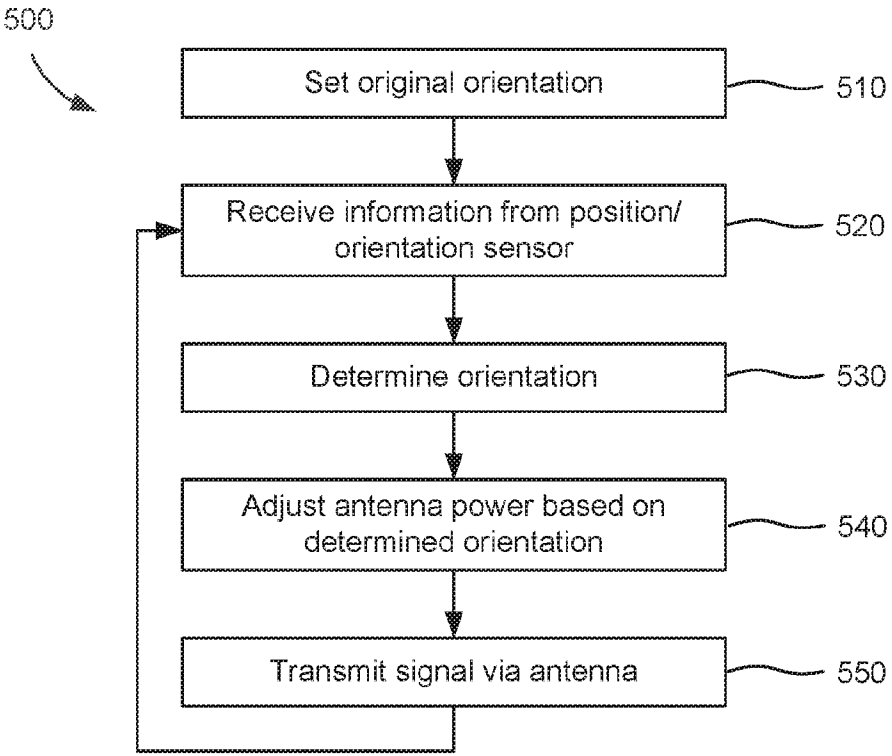
FIG. 5 illustrates a flow chart of a method for controlling antenna power based on the orientation and/or position of the trainable transceiver, according to an exemplary embodiment.

Referring now to FIG. 5, a flow chart illustrating a method 500 of controlling antenna power in a trainable transceiver (e.g., trainable transceiver 300 as shown in FIGS. 3-4, etc.) is illustrated according to one embodiment. In some embodiments, the trainable transceiver may set an original orientation at 510. The original orientation may be used as a reference point for changes in orientation. In one embodiment, the original orientation may be set using measurements from one or more position/orientation sensors taken as part of the manufacturing process. In one embodiment, the original orientation may be set using measurements from one or more position/orientation sensors taken as part of the manufacturing process. In one embodiment, the original orientation may be set using measurements from one or more position/orientation sensors taken during the training of the trainable transceiver. In one embodiment, the original orientation may be set using measurements from one or more position/orientation sensors taken during the first user input received via the operator input device and corresponding to the transmission of a signal. In one embodiment, the original orientation may be set using measurements from one or more position/orientation sensors taken during a first transmission of a signal following a predetermined amount of time from the prior transmission of a signal (e.g., 1 hour, 5 hours, 1 day, a week, or another amount of time). In still further embodiments, the original orientation may be a reference point or frame which is determined using one or more position/orientation sensors without being based on other activities of the trainable transceiver. For example, the original orientation may be set based on the relationship between the trainable transceiver and gravity (e.g., using an inclinometer), a magnetic field (e.g., using a magnetometer), and/or another substantially constant force or reference. In alternative embodiments, this step is not performed.

The trainable transceiver (e.g., the control circuit) receives information from one or more position/orientation sensors at 520. In some embodiments, the trainable transceiver receives position and/or orientation information from the sensors at all times. In alternative embodiments, the trainable transceiver receiver position and/or orientation information in response to a user input receiver via the operator input device and corresponding to the sending of a transmission.

The trainable transceiver may determines the orientation and/or position of the trainable transceiver at 530. In some embodiments, the control circuit determines the orientation and/or position of the trainable transceiver. For example, an orientation module stored in memory may be executed by a processor to determine the orientation and/or position of the trainable transceiver based on the information received from the position/orientation sensor(s). One or more of a variety of techniques may be used to determine the orientation. For example, a lookup table, algorithm, formula, model, and/or other technique may be used.

The power provided to the transceiver circuit and/or antenna may be adjusted and/or selected based on the determined orientation at 540. For example, a control module executed by the control circuit may determine the amount of power to provide the transceiver circuit and/or antenna based on the determined orientation. One or more of a variety of techniques may be used to determine the amount of power to provide the transceiver circuit and/or antenna. For example, a lookup table, algorithm, formula, model, and/or other technique may be used.

The signal may be transmitted using the antenna and using the amount of power determined by the trainable transceiver based on the determined orientation at 550. The control circuit may control the amount of power provided to the transceiver circuit and/or antenna using one or more power regulation components. Power may be provided to the transceiver circuit and/or antenna from a power source. The transmission may be formatted by the transceiver circuit and/or control circuit. For example, the transmission may be an activation signal and may be formatted by the control circuit and/or transceiver circuit based on information stored in memory. In some embodiments, multiple iterations may occur. Following the transmission, the control circuit may wait for another user input and/or begin receiving information from the position/orientation sensor(s).

Further Embodiments of the Trainable Transceiver for Altering the Beam Pattern Produced by the Trainable Transceiver Referring again to FIG. 3, the trainable transceiver 300 includes a fixed antenna 336 in some embodiments. In other embodiments, the antenna 336 may be a plurality of antennas. The plurality of antennas may be used to direct the transmissions from the trainable transceiver 300 based on the orientation of the trainable transceiver 300. For example, the plurality of antennas may be arranged in a phased array configuration. The output from the phased array may be controlled using beamforming techniques to steer transmissions from the trainable transceiver 300 in order to compensate for changes in the position and/or orientation of the trainable transceiver 300. In other embodiments, the plurality of antennas may be arranged in various directions and/or orientations. Based on the orientation of the trainable transceiver 300, one of the plurality of antennas may be selected for use in transmitting. This may allow the trainable transceiver to 300 compensate for changes in position and/or orientation.

The control circuit 304 and/or control module 320 may be used to control the use of a plurality of antennas. One or more of the techniques previously described herein may be used. For example, the control module 320 may select one of a plurality of antennas using a lookup table and based on a determined orientation. Each of the plurality of antennas may correspond to a specific orientation or range of orientations in the lookup table. In some embodiments, multiple antennas may be controlled using beam forming techniques, selecting from one of a plurality of antenna options, and/or otherwise controlled to produce a beam pattern with a specific electric field strength and/or other qualities at a fixed point from the trainable transceiver 300.

In some embodiments, one or more of the multiple antenna techniques described herein may be used in conjunction with the previously described techniques for controlling the amount of power provided to the antenna 336. For example, one of plurality of antennas may be selected based on the orientation of the trainable transceiver 300. Additionally, an amount of power may be provided to the antenna 336 based on the orientation of the trainable transceiver 300, based on a peak threshold value for electric field strength at a fixed point, in order to maintain the effective range of the trainable transceiver 300, and/or based on other factors. In alternative embodiments, the amount of power provided to the antenna 336 and/or transceiver circuit 332 is not varied in cases in which the trainable transceiver 300 includes multiple antennas.

Further Embodiments of the Trainable Transceiver

The trainable transceiver as described herein may have various alternative configurations in alternative embodiments. Some alternative embodiments are described as follows. Referring again to FIG. 2, and in greater detail, an exemplary embodiment of a trainable transceiver 200 is illustrated along with an exemplary embodiment of a home electronics device/remote device 240 and an exemplary embodiment of an original transmitter 280. In one embodiment, the trainable transceiver 200 includes an operator input device 204. The operator input device 204 may be one or more buttons. For example, the operator input device 204 may be three hard key buttons. In some embodiments, the operator input device 204 may include input devices such as touchscreen displays, switches, microphones, knobs, touch sensor (e.g., projected capacitance sensor resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 204 may display data to a user or otherwise provide outputs. For example, the operator input device 204 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 24 is connected to a control circuit 208. The control circuit 208 may send information and or control signals or instructions to the operator input device 204. For example, the control circuit 208 may send output instructions to the operator input device 204 causing the display of an image. The control circuit 208 may also receive input signals, instructions, and/or data from the operator input device 204.

The control circuit 208 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 208 may be a system on a chip (SoC) individually or with additional hardware components described herein. The control circuit 208 may further include, in some embodiments, memory 212 (e.g., random access memory, read only memory, flash memory, hard disk storage, flash memory storage, solid state drive memory, etc.). In further embodiments, the control circuit 208 may function as a controller for one or more hardware components included in the trainable transceiver 200. For example, the control circuit 208 may function as a controller for a touchscreen display or other operator input device 204, a controller for a transceiver, transmitter, receiver, or other communication device (e.g., implement a Bluetooth communications protocol).

The control circuit 208 is coupled to memory 212. The memory 212 may be used to facilitate the functions of the trainable transceiver 200 described herein. Memory 212 may be volatile and/or non-volatile memory. For example, memory 212 may be random access memory, read only memory, flash memory, hard disk storage, flash memory storage, solid state drive memory, etc. In some embodiments, the control circuit 208 reads and writes to memory 212. Memory 212 may include computer code modules, data, computer instructions, or other information which may be executed by the control circuit 208 or otherwise facilitate the functions of the trainable transceiver 200 described herein. For example, memory 212 may include encryption codes, pairing information, identification information, a device registry, etc. Memory 212 may include computer instructions, codes, programs, etc. which are used to implement the algorithms described herein.

The trainable transceiver 200 may further include a transceiver circuit 216 coupled to the control circuit 208. The transceiver circuit 216 allows the trainable transceiver 200 to transmit and/or receive wireless communication signals. Wireless communication signals may be or include activation signals, control signals, activation signal parameters, status information, notifications, diagnostic information, training information, instructions, and/or other information. The wireless communication signals may be transmitted to or received from a variety of wireless devices (e.g., an original transmitter, home electronic device, mobile communications device, and/or remote device). The transceiver circuit 216 may be controlled by the control circuit 208. For example, the control circuit 208 may turn on or off the transceiver circuit 216, the control circuit 208 may send data using the transceiver circuit 216, format information, an activation signal, control signal, and/or other signal or data for transmission via the transceiver circuit 216, or otherwise control the transceiver circuit 216. In some embodiments, the transceiver circuit 216 may include additional hardware such as processors, memory, integrated circuits, antennas, etc. The transceiver circuit 216 may process information prior to transmission or upon reception and prior to passing the information to the control circuit 208. In some embodiments, the transceiver circuit 216 may be coupled directly to memory 212 (e.g., to store encryption data, retrieve encryption data, etc.). In further embodiments, the transceiver circuit 216 may include one or more transceivers, transmitters, receivers, etc. For example, the transceiver circuit 216 may include an optical transceiver, near field communication (NFC) transceiver, etc. In some embodiments, the transceiver circuit 216 may be implemented as a system on a chip. The transceiver circuit 216 may be used to format and/or send activation signals to a device which cause the device to take an action and/or otherwise allows communication with the device. The activation signal may include activation signal parameters and/or other information. The transceiver circuit 216 may be or include a radio frequency transceiver (e.g., a transceiver which sends or receives wireless transmission using radio frequency electromagnetic radiation). For example, the transceiver circuit 216 and/or control circuit 208 may modulate radio waves to encode information onto radio frequency electromagnetic radiation produced by the transceiver circuit 216 and/or demodulate radio frequency electromagnetic radiation received by the transceiver circuit 216.

In some embodiments, the transceiver circuit 216 may include additional hardware such as one or more antennas, voltage controlled oscillator circuitry, amplifiers, filters, antenna tuning circuitry, volt meters, and/or other circuitry for the generation of and/or reception of modulated radio waves of different frequencies. The transceiver circuit 216 may provide for the functions described herein using techniques such as modulation, encoding of data onto a carrier wave, decoding data from a modulated carrier wave, signal strength detection, (e.g., computing and/or measuring voltage per length received by an antenna), antenna power regulation, and/or other functions related to the generation of and/or reception of radio waves. For example, the transceiver circuit 216 may be used to generate a carrier wave and encode onto the carrier wave (e.g., through modulation of the carrier wave such as frequency modulation or amplitude modulation) information such as control data, activation signal parameters, an encryption code (e.g., rolling code value), and/or other information. The transceiver circuit 216 may also be used to receive carrier waves and demodulate information contained within the carrier wave. The trainable transceiver 200 may be tuned (e.g., through antenna tuning) or otherwise controlled to send and/or receive radio waves (e.g., modulated carrier waves) at certain frequencies or channels and/or with a certain bandwidth.

The trainable transceiver 200 may communicate with original transmitters, home electronic devices, remote devices, mobile communications devices, network devices, and/or other devices as described above using the transceiver circuit 216 and/or other additional transceiver circuits or hardware. The devices with which the trainable transceiver 200 communicates may include transceivers, transmitters, and/or receivers. The communication may be one-way or two-way communication.

With continued reference to FIG. 2, a home electronics device or remote device 240 may include hardware components for communication with a trainable transceiver or original transmitter. In some embodiments, the home electronics device or remote device 240 includes a transceiver circuit 248. The transceiver circuit 248 may be used to send and/or receive wireless transmissions. For example, the transceiver circuit 248 may be or include a transceiver which sends and/or receives radio frequency electromagnetic signals. The transceiver circuit 248 may allow a home electronics device or remote device 240 to receive an activation signal and/or other transmission from a trainable transceiver or original transmitter. For example, a trainable transceiver may transmit an activation signal using activation signal parameters acquired as part of a training process. The home electronics device or remote device 240 may receive the activation signal using a transceiver circuit 248. The transceiver circuit 248 may be configured to transmit signals to a trainable transceiver, original transmitter, and/or other device. For example, the home electronics device or remote device 240 may transmit status information (e.g., that a garage door is closed) or other information. In some embodiments, the trainable transceiver 200 is configured to send and/or receive signals using multiple channels (e.g., a plurality of frequencies of radio waves used for communication). The transceiver circuit 248 of the home electronics device or remote device 240 may function in the same or similar manner as described with reference to the transceiver circuit 216 of the trainable transceiver 200.

The home electronics device or remote device 240 includes memory 244 and/or a control circuit 252 in some embodiments. The memory 244 and/or control circuit 252 may facilitate and/or carry out the functions of the home electronics device or remote device 240 described herein. The control circuit 252 and/or memory 244 may be the same or similar to the control circuit 208 and/or memory 212 described with respect to the trainable transceiver 200. For example, the control circuit 252 may be or include a processor and the memory 244 may be or include volatile (e.g., flash memory) and/or non-volatile memory (e.g., hard disk storage). The control circuit 252 may carry out computer programs, instructions, and or otherwise use information stored in memory 244 to perform the functions of the home electronics device or remote device 244. For example, the control circuit 252 and memory 244 may be used to process an activation signal (e.g., perform encryption related tasks such as comparing a received key with a stored key, handling instructions included in the signal, executing instructions, processing information, and/or otherwise manipulating or handling a received signal) received by the transceiver circuit 248 and/or control an interaction device 260 in response to the activation signal.

The home electronics device or remote device 240 may further include an interaction device 260. The interaction device may allow the home electronics device or remote device 240 to interact with another device, component, other hardware, the environment, and/or otherwise allow the home electronics device or remote device 240 to affect itself or something else. The interaction device 260 may be an electrical device such as a light, transceiver, networking hardware. The interaction device 260 may also or alternatively be an electromechanical device such as electric motor, solenoid, or other hardware. The home electronics device or remote device 240 (e.g., a garage door opener) may transmit a signal to a trainable transceiver or original transmitter from which the activation signal originated. The transmission may include information such as receipt of the activation signal, status information about the garage door opener or associated hardware (e.g., the garage door is closed), and/or other information.

In some embodiments, the home electronics device or remote device 240 includes one or more sensors 256. Sensors 256 may be used by the device 240 to monitor itself, the environment, hardware controlled by the device, and/or otherwise provide information to the device. Sensors 256 may provide status information to the device. For example, sensors 256 may be or include, temperature sensors (e.g., thermistor, thermocouple, or other hardware for measuring temperature), movement or acceleration sensors (e.g., accelerometers, inclinometers, or other sensors for measuring orientation, movement, or a derivative thereof), safety beams (e.g., sensors which detect when an infrared, or other spectrum, beam of light is broken by an object), sensor which detect distance (e.g., an ultrasound emitter and receiver configured to determine distance of an object), pressure sensors (e.g., pressure transducer, strain gauge, etc.), or other sensor. In some embodiments, one or more sensors 256 are configured to determine the status of a garage door opener or garage door. For example, a pressure sensor may be used to determine if a garage door is closed (e.g., in contact with the ground and/or sensor.

With continued reference to FIG. 2, components of an original transmitter 280 are illustrated according to an exemplary embodiment. The original transmitter 280 may include a transceiver circuit 284. As described with reference to the trainable transceiver 200, the transceiver circuit 284 of the original transmitter 280 may allow the original transmitter 280 to send transmissions to an associated device (e.g., home electronics device or remote device 240) and/or receive transmissions from an associated device. For example, an original transmitter 280 may send an activation signal to an associated device and/or may receive status information and or other information from the associated device.

The original transmitter may include a control circuit 288 and/or memory 292. The control circuit 288 and/or memory 292 may facilitate the functions of the original transmitter 280 in the same or similar fashion as described with reference to the trainable transceiver 200. For example, the control circuit 288 may receive a user input from an operator input device (e.g., button). The control circuit 288 may cause the transceiver circuit 284 to transmit an activation signal in response. One or more activation signal parameters may be read by the control circuit 288 from memory 292. For example, the memory of the original transmitter 280 may be non-volatile and store activation signal parameters for an associated device such as a frequency used to receive or send transmissions, frequencies used for the same, channels used for the same, encryption information (e.g., rolling code values, a seed value, etc.), device identification information, modulation scheme, and/or other information.

The transceiver circuit 216 of the trainable transceiver 200 and the transceiver circuit 248 of the home electronics device 240, remote device 240, original transistor, and/or other device may be configured to communicate send and/or receive wireless signals (e.g., activation signals, communication signals, and/or other signals). This may allow for communication between the trainable transceiver 200 and other device 240. In one embodiment, the transceiver circuits are configured to transmit and/or receive radio frequency transmissions. Communication between the trainable transceiver 200 and other device 240 may be unidirectional or bi-directional. In some embodiments, the trainable transceiver 200 and/or other device 240 may be configured to communicate using multiple frequencies. Each frequency may be a channel used for communication. A home electronics device 240, remote device 240, original transmitter 280, or other device may be configured to communicate using multiple channels for sending and/or receiving radio frequency transmissions using a transceiver circuit 248. For example, a home electronics device 240 (e.g., garage door opener) may be configured to communicate using multiple channels in the 900 MHz band. Continuing the example, a first channel may be 903.925 MHz and a second channel may be 904.075 MHz. In some embodiments, a single channel is used for transmission and/or reception. In other embodiments, a plurality of channels (e.g., two or more channels) are used for communication by the home electronics device 240, remote device 240, original transmitter 280, and/or other device.

The trainable transceiver 200 may be trained to use the same plurality of channels or single channel thereby allowing the trainable transceiver 200 to communicate with the device. The trainable transceiver 200 may be trained (e.g., through a training procedure) to send and/or receive radio frequency transmissions using the channel(s) the device is configured to use for transmitting and/or receiving transmissions. The trainable transceiver 200 may store the channel information and/or other information as activation signal parameters for use with the corresponding device. The trainable transceiver may store activation signal parameters (including channel frequencies used by the device) for one or more devices. Using the control circuit 208, memory 212, and/or transceiver circuit 216, the trainable transceiver 200 may format activation signals for a plurality of devices. This allows a single trainable transceiver 200 to control a plurality of devices depending on the user input. For example, a trainable transceiver 200 may receive a first user input and format a first activation signal for the device corresponding to a first device associated with the user input. The first activation signal may include or use a first channel or group of channels associated with the first device. This may allow the first device to communicate with the trainable transceiver using a plurality of channels. Continuing the example, a trainable transceiver 200 may receive a second user input and format a second activation signal for the device corresponding to a second device associated with the user input. The second activation signal may include or use a second channel or group of channels associated with the second device. This may allow the second device to communicate with the trainable transceiver 200 using a plurality of channels.

A trainable transceiver 200 may be trained to an existing original transmitter 280 such that the trainable transceiver 200 may control the device associated with the original transmitter 280. For example, a user may place the trainable transceiver 200 and original transmitter 280 such that the trainable transceiver 200 is within the transmission range of the original transmitter 280. The user may then cause the original transmitter 280 to send an activation signal or other transmission (e.g., by depressing a button on the original transmitter 280). The trainable transceiver 200 may identify one or more activation signal parameters, the device, and/or other information based on the transmission from the original transmitter 280 which the trainable transceiver 200 may receive using the transceiver circuit 216. The control circuit 208, memory 212, and/or other transceiver circuit may identify, determine, and or store information such as the frequency, frequencies, or channels used by the original transmitter 280 and therefore the device associated with the original transmitter 280, a control code or other encryption information, carrier frequency, bandwidth, and or other information.

In some embodiments, the home electronics device 240, remote device 240, or other device may be configured to learn an identifier, encryption information, and/or other information from a trainable transceiver 200. For example, the device may be placed in a learning mode during which time a user sends a transmission from the trainable transceiver 200 (e.g., by providing an input causing the transmission). The device may receive the transmission and perform a function in response. For example, the device may send an acknowledgement transmission in response to receiving the transmission, send a transmission including a ready indication (e.g., that the device is synchronized with the trainable transceiver, encryption information has been exchanged, communication has been acknowledged on all channels used by the device, etc.), store an identifier of the trainable transceiver 200, and/or perform other functions. This may process may constitute a pairing of the trainable transceiver 200 and the home electronics device 240, remote device 240, or other device. For systems using a rolling code, the trainable transceiver 200 and device may be synchronized so that the counters of the trainable transceiver 200 and the device begin with the same rolling code value.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for controlling a device, comprising:

an antenna configured to receive power from a power source;

at least one orientation sensor; and a control circuit coupled to the antenna and the at least one orientation sensor, wherein the control circuit is configured to determine an orientation of the antenna based on data from the at least one orientation sensor, wherein the control circuit is configured to control an amount of power received by the antenna based on the determined orientation of the antenna to substantially maintain an effective range of the antenna regardless of a change in the orientation of the antenna, and wherein the trainable transceiver is configured to be capable of controlling the device based on at least one signal characteristic stored in memory during a training process.

2. The trainable transceiver as in claim 1, wherein the control circuit is configured to control the amount of power received by the antenna such that a strength of an electric field produced by the antenna, as measured at a fixed point relative to the antenna, remains substantially constant regardless of the orientation of the antenna.

3. The trainable transceiver as in claim 1, wherein the trainable transceiver further includes a position sensor, and the control circuit is configured determine a position of the antenna based on position data received from the position sensor.

4. The trainable transceiver of claim 3, wherein the control circuit is configured to control the amount of power received by the antenna such that the effective range of the antenna is substantially constant regardless of the position of the antenna within a defined space.

5. The trainable transceiver of claim 4, wherein the control circuit is configured to control the amount of power received by the antenna such that a strength of an electric field produced by the antenna, as measured at a fixed point relative to the antenna, remains substantially constant regardless of the position of the antenna within a defined space.

6. The trainable transceiver as in claim 1, wherein the antenna includes at least one of a dipole antenna, a loop antenna, a slot antenna, a parabolic reflector, a monopole antenna, or a wire antenna.

7. The trainable transceiver as in claim 1, wherein the orientation sensor includes at least one of an accelerometer, a magnetometer, a gyroscope, or an inclinometer.

8. A trainable transceiver for controlling a device, comprising:

a plurality of antennas having different orientations;

at least one orientation sensor; and a control circuit coupled to the plurality of antennas and the at least one orientation sensor, wherein the control circuit is configured to determine an orientation of the trainable transceiver based on data from the at least one orientation sensor, wherein the control circuit is configured to select an antenna from the plurality of antennas having different orientations based on the determined orientation of the trainable transceiver to substantially maintain an effective range of the trainable transceiver regardless of a change in the orientation of the trainable transceiver, and wherein the trainable transceiver is configured to be capable of controlling the device based on at least one signal characteristic stored in memory and determined based on a signal received from an original transmitter.

9. The trainable transceiver as in claim 8, wherein the control circuit is configured to select the antenna such that a strength of an electric field produced by the trainable transceiver remains, as measured at a fixed point relative to the trainable transceiver, substantially constant regardless of the orientation of the trainable transceiver.

10. A trainable transceiver for controlling a device, comprising:

a plurality of antennas configured to be controlled as a phased array;

at least one orientation sensor; and a control circuit coupled to the plurality of antennas and the at least one orientation sensor, wherein the control circuit is configured to determine an orientation of the trainable transceiver based on data from the at least one orientation sensor, wherein the control circuit is configured to control the antennas based on the determined orientation of the trainable transceiver to substantially maintain an effective range of the trainable transceiver regardless of a change in the orientation of the trainable transceiver, and wherein the trainable transceiver is configured to be capable of controlling the device based on at least one signal characteristic stored in memory and determined based on a signal received from an original transmitter.

11. The trainable transceiver as in claim 10, wherein the control circuit is configured to control the antennas such that a strength of an electric field produced by the trainable transceiver, as measured at a fixed point relative to the trainable transceiver, remains substantially constant regardless of the orientation of the trainable transceiver.

12. A method of controlling a transmission from a trainable transceiver for controlling a device, comprising:

receiving, at a control circuit, information from an orientation sensor;

determining, using the control circuit, the orientation of the trainable transceiver; and adjusting, using the control circuit and based on the determined orientation, an amount of power provided to an antenna of the trainable transceiver for use in transmitting to substantially maintain an effective range of the trainable transceiver regardless of a change in the orientation of the trainable transceiver, wherein the trainable transceiver is configured to be capable of controlling the device based on at least one signal characteristic stored in memory and determined based on a signal received from an original transmitter.

13. The method of claim 12, further comprising setting an original orientation using the control circuit and based on an orientation determined by the control circuit in response to a user input for sending a previous transmission.

14. The method as in claim 12, further comprising transmitting a signal using the adjusted amount of power, wherein the power is controlled by the control circuit and provided from a power source.

15. The method as in claim 12, wherein the control circuit adjusts the amount of power provided to the antenna such that a strength of an electric field produced by the antenna, as measured at a fixed point relative to the antenna, remains substantially constant regardless of the orientation of the trainable transceiver.

16. The method as in claim 12, wherein the antenna includes at least one of a dipole antenna, a loop antenna, a slot antenna, a parabolic reflector, a monopole antenna, or a wire antenna.

17. The method as in claim 12, wherein the orientation sensor includes at least of an accelerometer, a magnetometer, a gyroscope, or an inclinometer.

* * * * *